United States Patent [19]

DeLaurier et al.

[11] Patent Number: 4,844,690

[45] Date of Patent: Jul. 4, 1989

[54] DIFFUSER VANE SEAL FOR A CENTRIFUGAL COMPRESSOR

[75] Inventors: William S. DeLaurier, Liverpool; Howard W. Kirtland, N. Syracuse; Gordon L. Mount, West Monroe, all of N.Y.

[73] Assignee: Carrier Corporation, Syracuse, N.Y.

[21] Appl. No.: 694,552

[22] Filed: Jan. 24, 1985

[51] Int. Cl.[4] ..... F04D 27/02

[52] U.S. Cl. ..... 415/148; 415/158

[58] Field of Search ..... 415/148, 150, 157, 158, 415/168–170, 174, 171 R; 277/152, 233, 234, 188 R

[56] References Cited

U.S. PATENT DOCUMENTS

| | | | |
|---|---|---|---|
| 2,996,996 | 8/1961 | Jassniker | 415/150 X |
| 3,379,445 | 4/1968 | Fisher | 277/188 R X |
| 3,478,955 | 11/1969 | Kunderman | 415/158 |
| 3,749,513 | 7/1973 | Chute | 415/158 X |
| 4,378,194 | 3/1983 | Bandukwalla | 415/49 |
| 4,385,864 | 5/1983 | Zacherl | 415/174 X |
| 4,403,914 | 9/1983 | Rogo et al. | 415/150 X |
| 4,460,310 | 7/1984 | Plunkett | 415/26 |
| 4,527,949 | 7/1985 | Kirtland | 415/158 X |

FOREIGN PATENT DOCUMENTS

| | | | |
|---|---|---|---|
| 1270556 | 7/1960 | France | 415/158 |

*Primary Examiner*—Robert E. Garrett
*Assistant Examiner*—Joseph M. Pitko
*Attorney, Agent, or Firm*—Dana F. Bigelow

[57] ABSTRACT

In a centrifugal machine for a refrigeration or air conditioning system and including a casing, an impeller, a variable width diffuser assembly leading from the impeller, and a plurality of vanes received through respective complementary-shaped openings in a movable wall member, there is provided a sealing means in the openings between the vanes and movable wall member for preventing leakage of fluid through the openings, thereby increasing the operating efficiency of the machine.

4 Claims, 2 Drawing Sheets

DIFFUSER VANE SEAL FOR A CENTRIFUGAL COMPRESSOR

BACKGROUND OF THE INVENTION

This invention relates generally to centrifugal machines, and in particular to a diffuser vane seal for a variable width diffuser in a centrifugal compressor of the type used in refrigeration and air conditioning systems.

Flow stabilization through a centrifugal vapor compressor is a major problem when the compressor is used in situations where the load on the compressor varies over a wide range of volumetric flow rates. The compressor inlet, impeller, and diffuser passage must be designed to accommodate the maximum volumetric flow rate through the compressor. However, if the compressor inlet, impeller, and diffuser passage are designed to accommodate the maximum volumetric flow rate then flow through the compressor may be unstable when there is a relatively low flow rate therethrough. As volumetric flow rate is decreased from a relatively high stable range of flow rates, a range of slightly unstable flow is entered. In this range there appears to be a partial reversal of flow in the diffuser passage which creates a noise and lowers the efficiency of the compressor. Below this slightly unstable flow range, the compressor enters what is known as surge, wherein there are periodic complete flow reversals in the diffuser passage that decrease the efficiency of the compressor and which may degrade the integrity of compressor components.

Numerous modifications have bee developed for improving flow stability through a compressor at low volumetric flow rates because it is desirable to have a wide range of volumetric flow rates in many compressor applications. One such modification is the addition of guide vanes in the inlet to the compressor, wherein the guide vanes vary the flow direction and quantity of entering vapor.

Another modification is to vary the width of the diffuser passage in response to the load on the compressor. Normally, this is done by use of a diffuser movable wall which moves laterally across the diffuser passage to throttle vapor flow through the passage.

Yet another modification involves the use of the variable width diffuser in conjunction with fixed guide vanes. In one type arrangement, the diffuser vanes can be received through complementary-shaped openings in the movable wall of the variable width diffuser. One problem in this arrangement is that the vanes can vibrate in the openings if they are not properly disposed therein, thereby undesirably affecting their performance and useful life.

Another problem with this latter modification involves the clearance between the vanes and openings in the movable wall. Because the vapor pressure increases as the vapor or fluid flows from the impeller through the diffuser passage, the clearances between the vanes and openings allow vapor to flow into the cavity behind the vanes and the movable wall and thus cause an undesirable disruption of flow from the impeller through the diffuser passage, thereby decreasing compressor efficiency.

SUMMARY OF THE INVENTION

It is therefore an object of the present invention to provide an improved centrifugal machine.

A further object of the present invention is to provide an improved variable width diffuser assembly for a centrifugal machine.

It is a further object of the present invention to substantially eliminate leakage of fluid through the clearance between a vane and the movable wall in a variable width diffuser.

Another object of the present invnntion is to provide a centrifugal compressor having improved operating efficiency.

Still another object of the present invention is to provide an improved means for securing vanes in a variable width diffuser assembly.

These and other objects of the present invention are attained in a centrifugal machine including a casing, an impeller rotatably mounted therein for moving a fluid therethrough, and a variable width diffuser assembly comprising a stationary wall member being generally radially disposed about the impeller and a movable wall member being generally radially disposed about the impeller and spaced-apart from the stationary wall member to form therewith a fluid passage leading from the impeller. Means are provided to selectively move the movable wall member relative to the stationary wall member. A plurality of vanes are generally circumferentially disposed in the fluid passage and are slidably disposed in a respective plurality of complementary-shaped openings in the movable wall member. To seal clearances between the vanes and the respective openings, sealing means are disposed in the complementary-shaped openings between the vanes and movable wall member for preventing a flow of fluid through the openings, whereby compressor efficiency is increased.

BRIEF DESCRIPTION OF THE INVENTION

The above mentioned and other features and objects of this invention, and the manner of attaining them will become more apparent and the invention itself will be better understood by reference to the following description of an embodiment of the invention taken in conjunction with the accompanying drawings, wherein.

DESCRIPTION OF A PREFERRED EMBODIMENT

Figure 1:
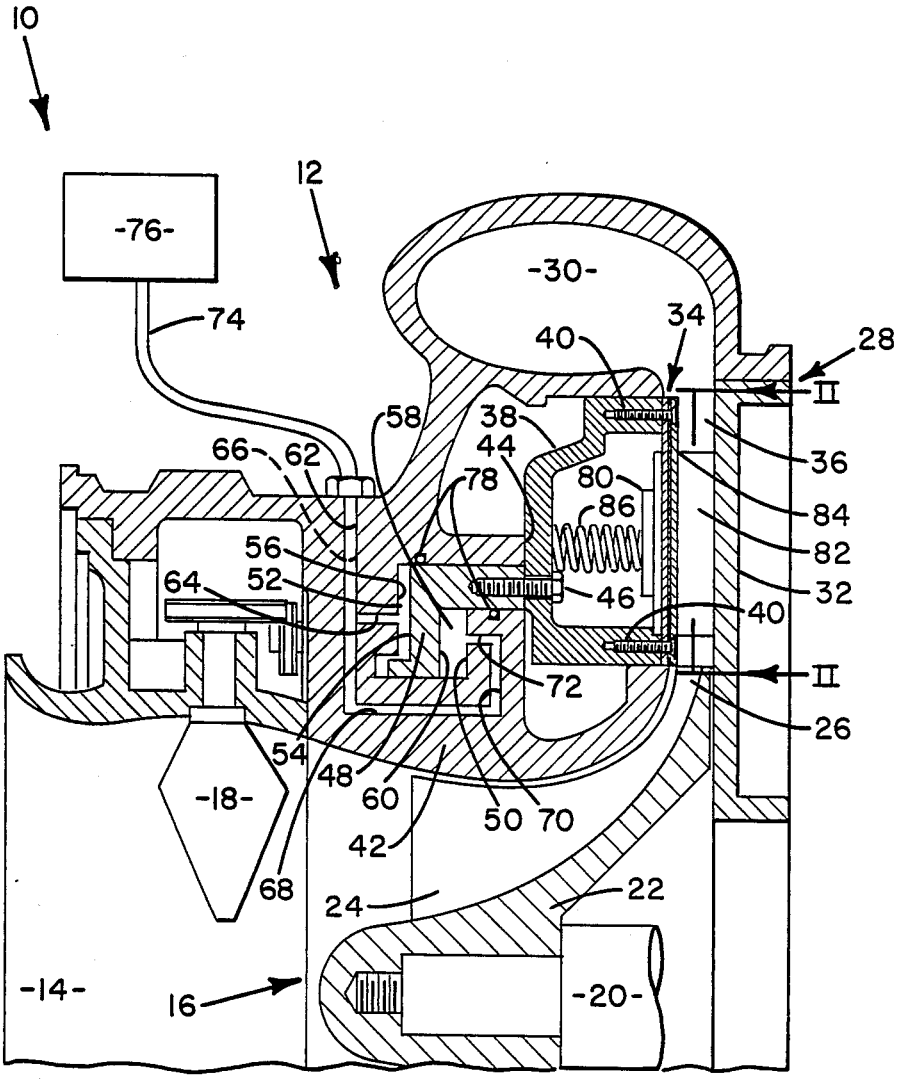
FIG. 1 is a fragmentary sectional side view of a centrifugal compressor incorporating a preferred embodiment of the present invention.

Referring primarily to FIG. 1, there is illustrated a centrifugal compressor 10 including main casing 12 having an inlet 14 that directs the refrigerant into a rotating impeller 16 through a series of adjustable inlet guide vanes 18. Impeller 16 is secured to drive shaft 20 by any suitable means to align impeller 16 along the axis of compressor 10. Impeller 16 includes central hub 22 supporting a plurality of blades 24. Blades 24 are arranged to create passages therebetween that turn the incoming axial flow of refrigerant fluid in a radial direction and discharge the compressed refrigerant fluid from respective blade tips 26 into diffuser section 28. Diffuser section 28 is generally circumferentially disposed about impeller 16 and functions to direct the compressed refrigerant fluid into a toroidal-shaped volute 30, which directs the compressed fluid to the compressor outlet (not shown).

Diffuser section 28 includes a radially disposed stationary wall 32 and radially disposed movable wall 34 which is spaced-apart from stationary wall 32. Movable wall 34 is arranged to move axially towards and away from stationary wall 32 to vary the width of diffuser passage 36 formed therebetween, thereby altering the operating characteristics of compressor 10 in regard to varying load demands or flow rates.

Movable wall 34 is secured to carriage 38 by screws 40 received through aligned openings (not shown) in movable wall 34 and carriage 38. Screws 40 draw movable wall 34 tightly against the front of carriage 38. Carriage 38 is movably mounted in compressor 10 between shroud 42 and main casing 12. Movable wall 34 is accurately located by means of dowel pins (not shown) received in aligned holes (not shown) in movable wall 34 and carriage 38.

Carriage 38 is illustrated as being fully retracted against stop surface 44 of main casing 12 to open diffuser passage 36 to a maximum flow handling position. Carriage 38 is securely fixed by screws 46 to a double-acting piston 48. Although the piston may be driven by either gas or liquid, it shall be assumed for explanatory purposes that it is liquid actuated. By introducing fluid under pressure to either side of piston 48, its axial position and thus that of carriage 38 and wall 34 can be controlled. Piston 48 is slidably mounted between shroud 42 and main casing 12 so that it can move movable wall 34 by means of carriage 38 between the previously noted maximum flow position against stop surface 44 and a minimum flow position wherein the piston is brought against shroud wall 50.

A first expandable chamber 52 is provided between piston front wall 54 and casing wall surface 56. Delivering fluid under pressure into chamber 52 drives piston 48 toward stationary wall 32. A second expandable chamber 58 is similarly located between piston back wall 60 and shroud wall 50. Directing fluid under pressure to chamber 58 causes piston 48 to be driven forward to increase the width of diffuser passage 36.

Fluid is delivered into chambers 52, 58 from a supply reservoir (not shown) by means of a pair of flow circuits. The first flow circuit leading to chamber 52 includes channels 62, 64. The second circuit includes channels 66, 68, 70 and 72 which act to deliver the drive fluid into chamber 58. Channels 62–72 are formed by drilling communicating holes into the machine elements and plugging the holes where appropriate. Channels 62, 66 are drilled one behind the other and thus appear as a single channel in FIG. 1. Both channels 62, 66 are connected to supply lines 74 in any suitable manner.

A suitable control system 76 containing electrically actuated valves regulates the flow of the fluid into and out of expandable chambers 52, 58 to either move piston 48 towards or away from stationary wall 32. A series of O-ring seals 78 encircle piston 48 and prevent fluid from passing between chambers 52, 58. Control system 76 controls the position of carriage 38 and thus movable wall 34 to vary the width of diffuser passage 36. Although described in terms of control system 76, the present invention contemplates other types of systems or methods for moving wall 34.

Figure 2:
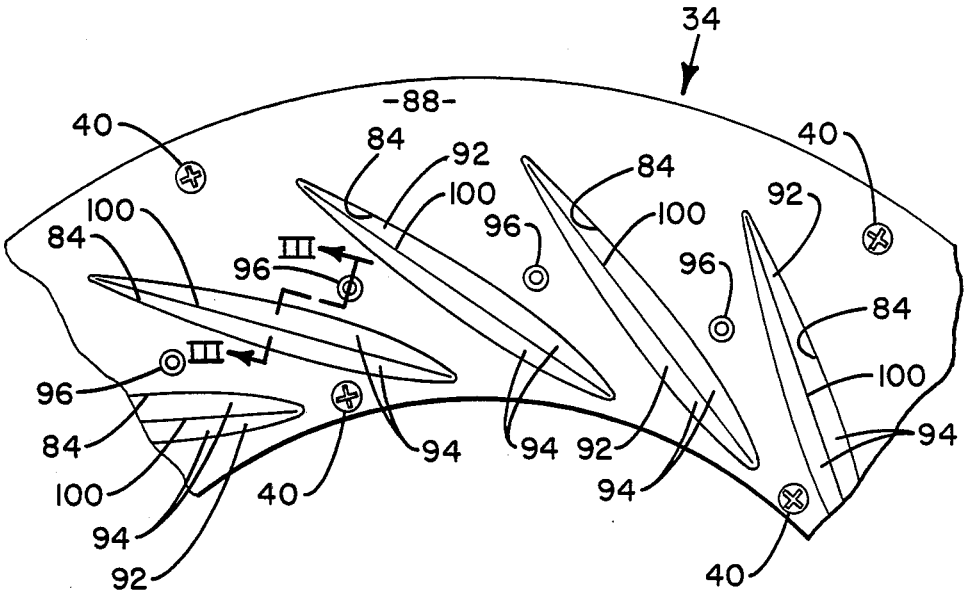
FIG. 2 is a fragmentary sectional view of FIG. 1 taken substantially along line II—II and viewed in the direction of the arrows.
Figure 3:
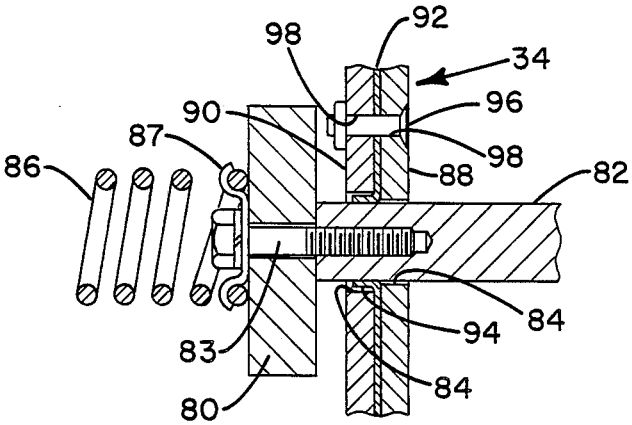
FIG. 3 is a sectional view of FIG. 2 taken substantially along line III—III and viewed in the direction of the arrows.

Referring now to FIGS. 1–3, an annular ring 80 has a plurality of fixed vanes 82 secured thereto in any suitable manner, for example, by screws 83 threadedly received through aligned openings in annular ring 80 and vanes 82. The term "fixed vane" is used herein to define an airfoil-like shape whose pitch or angle of attack in regard to the compressed fluid moving through diffuser passage 36 does not change. Vanes 82 may be of any suitable contour, such as NACA airfoils, and are equally spaced on annular ring 80 so as to be slidably received in complementary-shaped slots 84 in movable wall 34. A plurality of springs 86 are annularly positioned between annular ring 80 and carriage 38 so as to bias vanes 82 against stationary wall 32 during movement of movable wall 34. Springs 86 can be fixed to ring 80 by spring brackets 87 and screws 83. Thus, regardless of the position of movable wall 34 relative to stationary wall 32, vanes 82 continuously span diffuser passage 36. Further, vibration of vanes 82 within respective slots 84 is virtually eliminated.

Referring still to FIGS. 1–3, it can be seen that movable wall 34 comprises a pair of plate members 88, 90 (FIG. 3) secured together with their respective slots 84 in alignment. Disposed between plate members 88, 90 is a sheet of sealing material 92 having respective flange-like portions 94 disposed in respective slots 84 between respective vanes 82 and plate member 90. Although not illustrated, the present invention contemplates sealing portions 94 also being disposed in slots 84 between vanes 82 and plate member 88. Further contemplated is a pair of sheet sealing materials 92 wherein their respective sealing portions are respectively disposed between vanes 82 and plate member 88 and vanes 82 and plate member 90.

Thus, with the clearances between vanes 82 and movable wall 34 sealed by respective sealing portions 94, there is virtually no leakage of vapor or fluid through slots 84, thereby preventing disruption of fluid flow from impeller 16 through diffuser passage 36 and resulting in increased operating efficiency of compressor 10.

Movable wall 34 is assembled by providing plate members 88, 90 with aligned slots 84 and disposing therebetween a sheet of sealing material 92. Plate members 88, 90 and sealing material 92 are then securely joined together, for example, by rivets 96 received through aligned openings 98 in plate members 88, 90. Generally, no similarly aligned openings are necessary for sealing material 92 since it is relatively thin and flexible, thereby allowing the riveting of plate members 88, 90 to be satisfactorily and easily accomplished. Thereafter, slits 100 (FIG. 2) are cut in respective sealing portions 94 exposed by slots 84. Then, vanes 82, which are secured to annular ring 80, are slidably received through respective slots 84. Upon passing through slots 84, vanes 82 forcibly move against sealing portions 94 to cause portions 94 to flex inwardly between vanes 82 and wall member 34. Alternatively, vanes 82 may be individually respectively received through slots 84 and thereafter secured to annular ring 80.

Sealing material 92 can be any material suitable to expected operating conditions, such as high temperatures, types of refrigerant, and the like. One such suitable material is polytetrafluoroethylene, more commonly known as and marketed under the trademark Teflon. Further, the thickness of sealing material 92 can be varied depending upon the clearance between each vane 82 and movable wall 34.

While this invention has been described as having a preferred embodiment, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. In a centrifugal machine including a casing and an impeller rotatably mounted therein for compressing a refrigerant vapor therein, a variable with diffuser assembly, comprising:

a stationary wall member being generally radially disposed about said impeller, a movable wall member being generally radially disposed about said impeller and spaced-apart from stationary wall member to form therewith a vapor passage leading from said impeller, means operatively connected to said movable wall member for selectively moving said movable wall member relative to said stationary wall member, a plurality of vanes generally circumferentially disposed in said vapor passage and being slidably disposed in a respective plurality of complementary-shaped openings in said movable wall member, said movable wall member including a pair of oppositely disposed plate members respectively having-said complementary-shaped openings disposed therethrough, and sealing means disposed between said plate members and having portions thereof disposed in respective said complementary-shaped openings between said vanes and at least one of said plate members for preventing leakage of compressed vapor through said openings.

2. The machine of claim 1 wherein the sealing means is a sheet of sealing material.

3. The machine of claim 2 wherein said sealing material is a polymer material.

4. The machine of claim 3 wherein said polymer material is polytetrafluoroethylene.

* * * * *